United States Patent [19]

Sanderson

[11] 4,388,766

[45] Jun. 21, 1983

[54] HUMIDITY-CONTROLLED DIVERTER VALVE

[76] Inventor: L. Wayne Sanderson, 5407 Knob Rd., Nashville, Tenn. 37209

[21] Appl. No.: 293,495

[22] Filed: Aug. 17, 1981

[51] Int. Cl.[3] ..... F26B 11/04

[52] U.S. Cl. ..... 34/54; 34/86; 34/133; 34/235; 137/865; 137/875; 236/44 A; 251/250

[58] Field of Search ..... 126/113; 236/44 R, 44 A; 34/50, 46, 48, 54, 133, 235, 86; 137/865, 875; 251/250

[56] References Cited

U.S. PATENT DOCUMENTS

| | | | |
|---|---|---|---|
| 1,981,234 | 11/1934 | Hetzer | 34/77 |
| 3,592,221 | 7/1971 | Worley | 137/875 |
| 3,673,701 | 7/1972 | Albertson | 34/133 |
| 4,011,662 | 3/1977 | Davis et al. | 34/86 |
| 4,145,818 | 3/1979 | Kulling | 34/77 |

*Primary Examiner*—Larry I. Schwartz
*Attorney, Agent, or Firm*—Harrington A. Lackey

[57] ABSTRACT

A fluid flow control device including an inlet and a pair of outlets and a diverter valve selectively operable to place the inlet in fluid communication with either the first or second outlet in response to a humidity sensitive control mechanism. The fluid flow control device is particularly adapted for utilization with an automatic clothes dryer in which the inlet is coupled to the exhaust outlet of the dryer and the valve is actuated to open the first outlet, communicating with the outside of the house, for example, when the humidity within the exhaust air exceeds a threshold value, and to open the second outlet, which is in communication with an interior space or with a duct in a hot air circulating system, when the humidity of the dryer exhaust air is below the threshold value.

7 Claims, 6 Drawing Figures

HUMIDITY-CONTROLLED DIVERTER VALVE

BACKGROUND OF THE INVENTION

This invention relates to fluid flow control devices, and more particularly to a humidity-controlled diverter valve, particularly adapted for the selective diversion of exhaust air from automatic clothes dryers.

Manually operated, pivotally supported, diverter valves in Y-shaped fluid conduits for diverting the flow of fluid, such as water, selectively between the inlet to the fluid conduit and a pair of outlets, are well known in the art, as disclosed in U.S. Pat. No. 83,808, of Van Norman et al, issued Nov. 3, 1968, and U.S. Pat. No. 121,960, issued to Peters on Dec. 19, 1871.

Furthermore, manually operated diverter valves in which the inlet is connected to the exhaust outlet of an automatic clothes dryer and in which one outlet transmits hot moist air to the exterior of the enclosure or house, and the other outlet transmits exhaust air to a space within the house or enclosure, or to a duct within a hot air circulating system within the house, are disclosed in U.S. Pat. No. 4,034,482 of Briscoe, issued July 12, 1977, No. 4,122,612 of Mrofchak, issued Oct. 31, 1978, and No. 4,156,973. However, all of the diverter valves disclosed in these patents are controlled manually.

Humidity sensors for controlling the operation of automatic clothes dryers, and particularly for terminating the operation of the dryer when a predetermined humidity and/or temperature condition is sensed, are disclosed in the following U.S. Pat. Nos.:

3,253,347 Kripke, May 31, 1966:
3,269,027 Harnden, Jr., Aug. 30, 1966:
4,221,058 Zagorzycki, Sept. 9, 1980.

However, none of the above 3 patents, Kripke, Harnden, Jr., or Zagorzycki, utilizes a humidity sensor for controlling a diverter valve in the hot air exhaust flow from the dryer in order to control the flow of hot moist exhaust air to the interior or exterior of a house or enclosure.

SUMMARY OF THE INVENTION

It is therefore an object of this invention to provide in a fluid conduit having an inlet and a pair of outlets, a diverter valve selectively controlled by the humidity of the fluid within the conduit or the humidity in the ambient atmosphere.

More specifically, it is an object of this invention to provide a diverter valve for controlling the flow of hot exhaust air from an automatic clothes dryer within an enclosure, to the exterior of the enclosure or to the interior of the enclosure, in response to the humidity of the exhaust air.

A further object of this invention is to provide a diverter valve device which may be coupled to the exhaust outlet of an existing automatic clothes dryer for selectively diverting the exhaust air to the exterior or interior of the enclosure for the dryer, or to provide such a diverter valve device which may be incorporated as original equipment in the automatic clothes dryer.

Another object of this invention is to provide humidity sensitive controls for a selectively actuable diverter valve in a fluid conduit, which controls may be supported upon the conduit, or mounted at a remote station for controlling the diverter valve.

Another object of this invention is to provide a diverter valve device for attachment to or within, the exhaust outlet of a conventional automatic clothes dryer in which the valve is open, in a first operational mode in response to an excessive humidity value, to discharge the hot moist air from the clothes dryer to the exterior of the enclosure for the dryer or the exterior of the living space. After the humidity of the hot exhaust air from the clothes dryer falls below a predetermined threshold value, the diverter valve is automatically shifted to a second operational mode to close the outlet to the exterior of the enclosure and to divert the less humid hot air into the living space, either directly, or through the ductwork of a hot air circulating system. Also, in a preferred form of the invention an automatic shut-off switch may be provided for terminating the operation of the clothes dryer after a predetermined period of discharging hot air into the living space.

More specifically, the diverter valve device made in accordance with this invention preferably includes a Y-shaped fluid conduit or valve housing including a pivotally mounted diverter valve member which can be selectively moved between first and second operational positions or modes for closing first one outlet or the other. This pivotal valve member may be fixed upon a rotary shaft which is journaled in bearings within the fluid conduit housing and projects above the housing where the shaft terminates in a pinion engaging a rack. The rack in turn forms a part of, or is connected to, the armature shaft of an electrical solenoid, which is energized by an electrical control responsive to a humidity sensor. The humidity sensor preferably is mounted within the valve housing or fluid conduit in the inlet flow path and upstream from the valve member in order to sense the humidity of the fluid entering the fluid conduit, such as the hot exhaust air discharging from the clothes dryer.

The electrical controls preferably include variable means for adjusting the signal from the humidity sensor in order to select different threshold values for the humidity at which the valve member is moved for diverting the flow of hot gases through one outlet or the other.

In a preferred form of the invention, the solenoid controlling the rotory or pivotal movement of the valve is energized by an excessive humidity signal to move the valve member to a first operational mode to open the passage of the hot moist exhaust air from a clothes dryer to the exterior of the house. After the humidity of the exhaust air has dropped to an acceptable level below the threshold value, the solenoid is de-energized to shift the valve member to a second operational mode to close the flow of air to the exterior and open the flow of air to the interior of the house. When the solenoid is de-energized, a spring is utilized to hold the valve member in its second operational mode. By utilizing this type of control mechanism, electrical energy is utilized only while the flow of air through the conduit is excessively humid.

Although the humidity sensor is normally mounted within the flow path of the controlled fluid, it is also within the scope of this invention to mount the humidity sensor exteriorly of the fluid conduit in order to sense the ambient or room humidity in order, for example, to prevent or reduce the flow of moist exhaust air into the room while the room air humidity is high.

DESCRIPTION OF THE PREFERRED EMBODIMENTS

Figure 1:
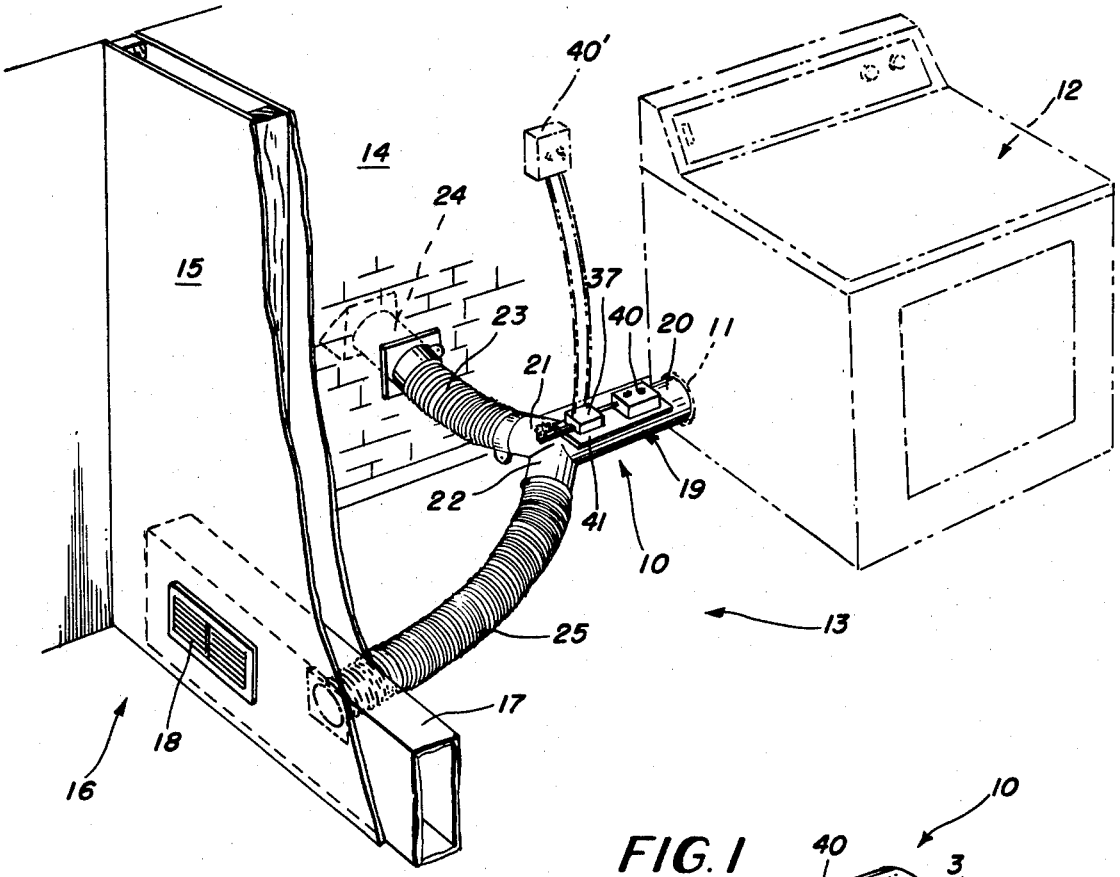
FIG. 1 is a top perspective view of the flow control device made in accordance with this invention, operatively connected to an automatic clothes dryer, shown in phantom, within an enclosure, and disclosing the first outlet of the control device connected to the exterior of the enclosure and the second outlet connected to a duct in a hot air circulating system within the enclosure.
Figure 2:
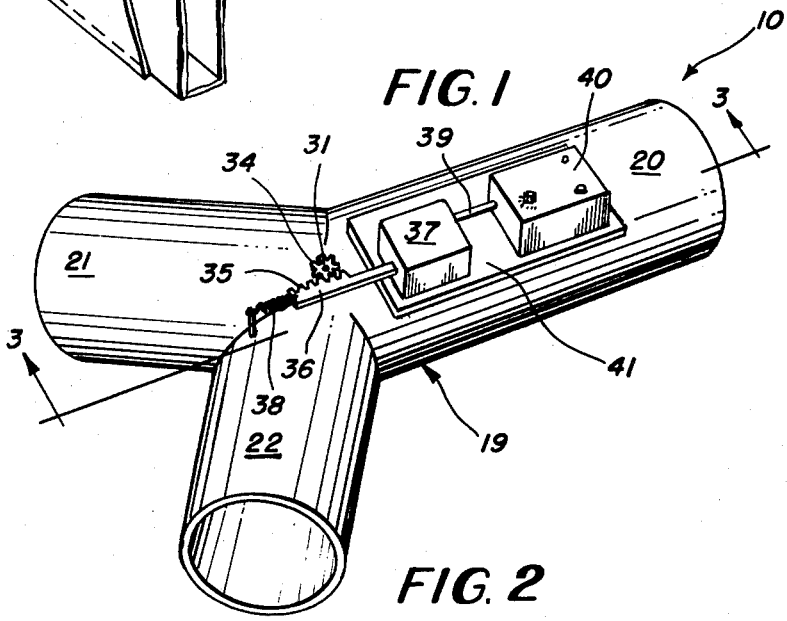
FIG. 2 is an enlarged top perspective view of the flow control device disclosed in FIG. 1.

Referring now to the drawings in more detail, FIG. 1 discloses the diverter valve device 10, made in accordance with this invention, operationally connected to the exhaust outlet 11 of a conventional automatic clothes dryer 12. The clothes dryer 12 may be located within an enclosed space, such as a utility room 13 having an exterior wall 14 and an interior wall 15, partitioning the utility room 13 from another room or living space 16. Mounted within the interior wall 15 is a hot air duct 17 forming a part of a hot air circulating system for the house or building, and provided with a hot air outlet or register 18 opening into the living area 16.

As disclosed in FIG. 1–4, the diverter valve device 10 includes a fluid tubular conduit or valve housing 19, preferably in a Y-shape, having a tubular main inlet portion 20, and a pair of divergent branch tubular outlet portions 21 and 22.

In the operational arrangement of the diverter valve device 10 disclosed in FIG. 1, the first outlet conduit portion 21 is coupled to a flexible hose or conduit 23, the opposite end of which is coupled to a vent fitting 24 extending through the exterior wall 14, so that the first outlet conduit portion 21 is in fluid communication with the outdoors, or space on the exterior side of the exterior wall 14.

The second outlet conduit portion 22 is coupled to a flexible hose 25, the opposite end of which is fitted into one wall of the hot air duct 17, so that the second outlet conduit portion 22 is in fluid communication with the hot air duct 17.

Figure 4:
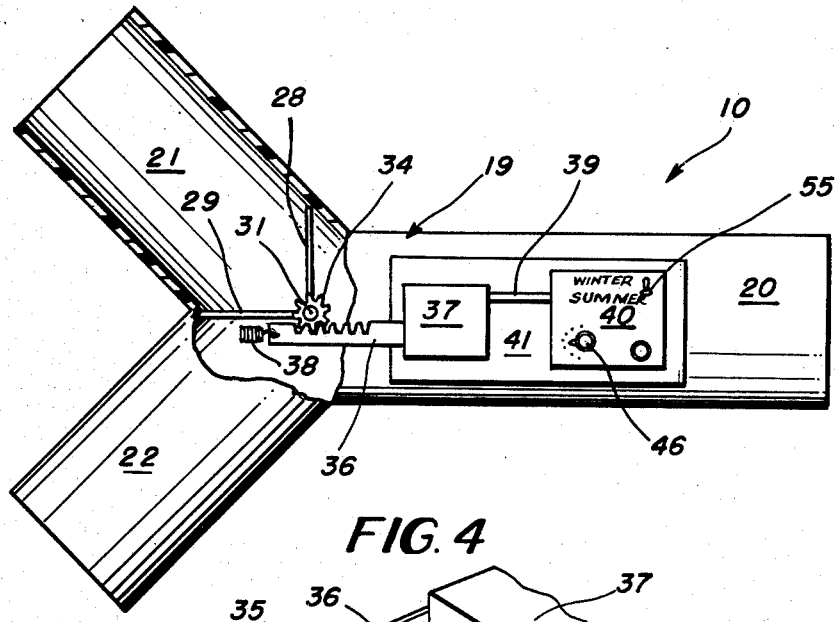
FIG. 4 is a top plan view of the flow control device disclosed in FIG. 1 with the outlet portions of the tubular conduit broken away to disclose the valve member in an operative mode closing the first outlet and opening the second outlet.
Figure 5:
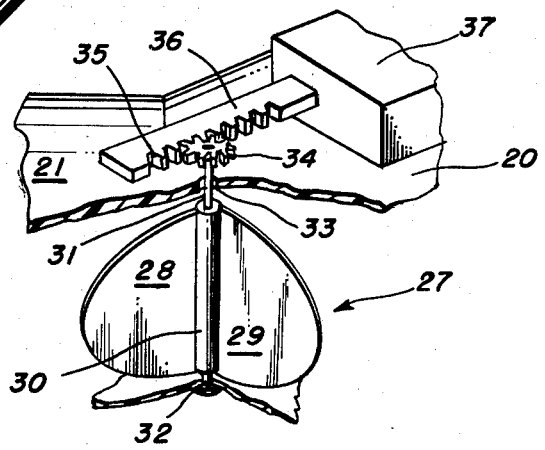
FIG. 5 is an enlarged, fragmentary, perspective sectional view of the valve member and its operative device.

Supported within the tubular conduit or valve housing 19 is a valve member 27 preferably constructed to include a pair of valves or vanes 28 and 29 disposed at a dihedral angle and projecting radially from an integral sleeve 30 fixed upon a vertically disposed rotary shaft 31, as best disclosed in FIGS. 4 and 5. The vanes 28 and 29 are shaped so that their peripheries snugly seat against the corresponding inner wall surfaces of the tubular outlet conduit portions 21 or 22 to completely close the flow of fluid through the corresponding outlet portion 21 or 22. FIG. 4 discloses the vanes 28 and 29 closing the first outlet portion 21.

The bottom end of the rotary shaft 31 is journaled in the bottom wall of the valve housing 19 in a journal bearing 32, while the upper end portion of the rotary shaft 31 projects through an upper journal bearing 33 in the top wall of the valve housing 19 and terminates at its upper end in a pinion 34. The pinion 34 operatively engages a rack 35 on an armature shaft 36 of an electrical solenoid 37. The free end of the armature shaft 36 is connected by a coil spring 38 to the top wall of the valve housing 19.

The solenoid 37 is supplied with current through the electrical conduit 39 from the electronic control unit 40 mounted upon a base or circuit board 41 fixed to the top wall of the valve housing 19.

Figure 3:
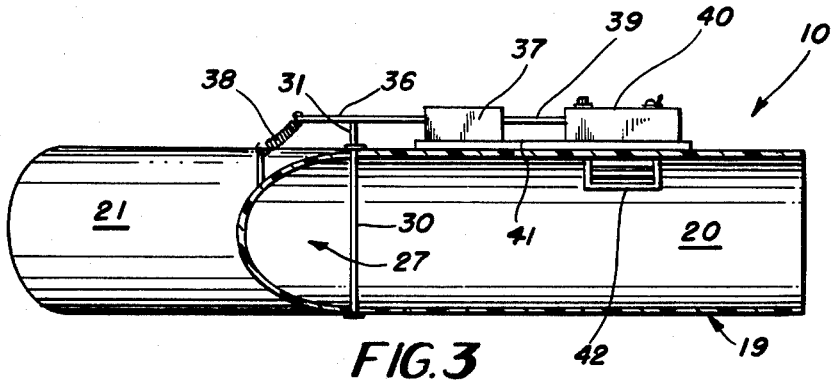
FIG. 3 is a section taken along the line 3—3 of FIG. 2.

Electrically connected to the electronic control unit 40 and depending below the circuit board 41 through the top wall of the valve housing 19 and into the inlet tubular portion 20 is a conventional humidity sensor 42, as best disclosed in FIG. 3. The humidity sensor 42 is completely exposed to the flow of fluid or hot air through the inlet tubular portion 20, upstream from the valve member 27.

Figure 6:
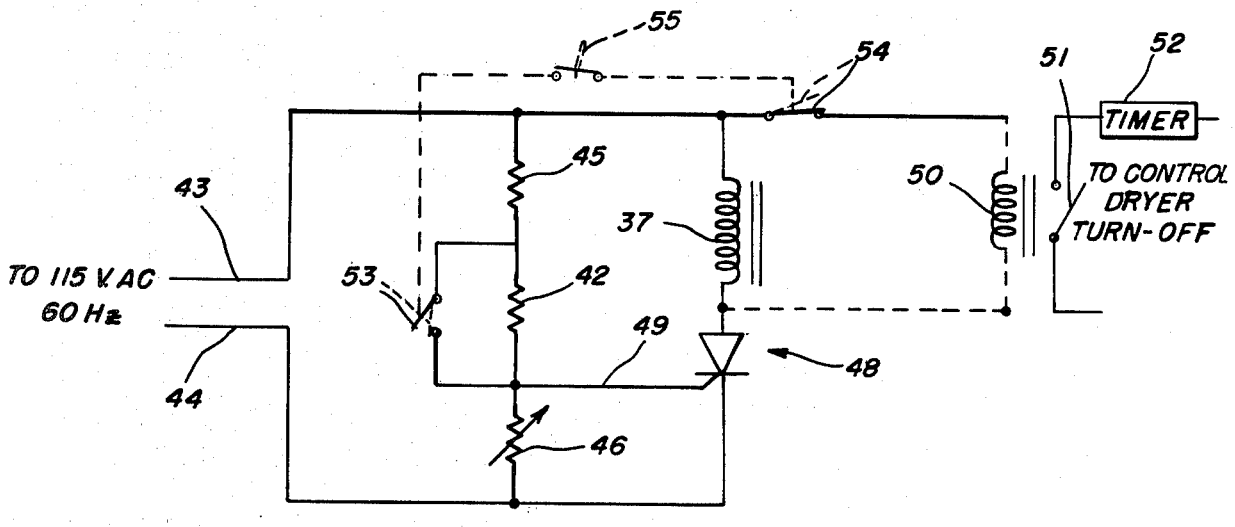
FIG. 6 is a schematic electrical diagram of the flow control device.

FIG. 6 illustrates a typical electrical circuit diagram for controlling the solenoid 37, and therefore the reciprocal movement of the valve member 27, in response to the humidity sensor 42.

A source of alternating current voltage, such as the 115-volt AC is applied across the input lead 43 and ground lead 44, and across a resistive divider network including in series a fixed resistor 45, the humidity sensor resistance 42 and a variable resistor, or potentiometer 46. Connected in parallel with the resistive divider network is the solenoid coil 37 connected in series with an SCR (silicon controlled rectifier) 48. The gate lead 49 of the SCR 48 is connected in the resistive divider network between the humidity sensor resistor 42 and the variable resistor 46.

As an optional feature, a relay coil 50 may be connected in parallel across the solenoid coil 37 for activating a relay switch 51 through a timer device 52 to the control circuitry of the clothes dryer 12. Thus, when the solenoid coil 37 and the relay coil 50 are simultaneously energized, the relay switch 51 is opened. When the solenoid coil 37 and relay switch 50 are deenergized, the relay switch 51 will be closed to activate the timer 52 for a predetermined period, after which the controls for the dryer 12 are de-energized to turn off or shut down the dryer 12.

A seasonal by-pass switch 53 is connected across the humidity sensor resistance 42, and a second seasonal switch 54 is connected in series between the coils 37 and 50. The seasonal switches 53 and 54 are ganged for simultaneous control by the manual switch lever 55 (FIGS. 4 and 6).

In the operation of the valve device 10 as it is operationally disclosed in FIG. 1, with its inlet connected to the exhaust 11 of the clothes dryer 12, its first outlet 21 connected to the vent fitting 24 and its second outlet 22 connected to the hot air duct 17, the valve member 27 is normally in its position disclosed in FIG. 4, closing the first outlet portion 21 and opening the second outlet portion 22, in a second operational mode. In the second operational mode, as illustrated in FIG. 4, the solenoid 37 is de-energized with the valve member 27 held in its position closing the first outlet 21 by the coil spring 38.

After the clothes dryer 12 is started, the hot air discharging from the exhaust outlet 11 begins flowing through the inlet portion 20, across the humidity sensor 42 and through the second outlet 22 and tubular conduit 25 into the hot air duct 17.

Assuming that the seasonal toggle switch 55 is turned to the "WINTER" position, illustrated in FIG. 4, then the seasonal by-pass switch 53 will be in its open solid-line position, and the seasonal switch 54 will be in its closed solid-line position, illustrated in FIG. 6.

Soon after the initiation of the operation of the clothes dryer 12, the hot exhaust air will rapidly develop a high humidity level, which exceeds the threshold humidity value determined by the variable resistor 46. A voltage signal will then be transmitted through the gate lead 49 to bias the SCR 48 into conduction, thereby energizing the solenoid 37 to rapidly rotate the rotary shaft 31, thereby pivoting the valve member 27 to the solid-line position of FIG. 5 to close the second outlet portion 22 and simultaneously open the first outlet portion 21, in a first operational mode. Immediately, the hot moist air flowing through the inlet tubular portion 20 will discharge through the first outlet portion 21, the flexible hose 23 and out through the vent fitting 24 to the outdoors, or space outside the exterior wall 14. Thus, the hot moisture-laden air will be discharged outside of the living space from the clothes dryer 12. As the clothes in the dryer 12 are gradually dried, the humidity level in the exhaust air entering the valve device 19 will gradually decrease until the humidity drops below the threshold value determined by the humidity sensor 42 and the variable resistor 46. When the humidity is below the threshold value, the voltage signal through the gate lead 49 ceases and the changing alternating current through the SCR 48 will turn off the SCR 48 to de-energize the solenoid coil 37 and the relay coil 50. When the solenoid coil 37 is de-energized, the coil spring 38 immediately protracts the armature shaft 36, simultaneously rotating the rotary shaft 31 to cause the valve member 27 to return to its original solid-line position disclosed in FIG. 4, in its second operational mode. Immediately, the hot exhaust air from the dryer 12 with moderate humidity is discharged through the second outlet 22, conduit 25 into the hot air duct 17, thereby furnishing additional hot air at a comfortable humidity to the duct 17 to heat the interior living area, such as the room 16, through the outlet 18.

Furthermore, when the relay coil 37 is de-energized, the relay coil 50 will also be simultaneously de-energized to close the relay switch 51, thereby starting the timer 52 to count for a predetermined period. After the timer 52 times out, the controls for the clothes dryer are actuated to stop the drying cycle and shut down the dryer 12. All of the elements in the diverter valve device 10 will remain in their de-energized positions in the second operational mode, until the dryer 12 is re-started for its next drying cycle, at which time the operation of the diverter valve device 10 will be repeated.

In the summertime, no hot air, moist or dry, is desired within the living space, such as in the space 16. Accordingly, the seasonal toggle switch 55 is turned to the "SUMMER" position, illustrated in FIG. 4, thereby moving the switches 53 and 54 to their dashed-line positions disclosed in FIG. 6. The seasonal switch 53 in its dashed-line closed position bypasses the humidity sensor 42, while the seasonal switch 54 opens the circuit to isolate the relay coil 50. Thus, as the drying cycle is commenced in the clothes dryer 12, the supply voltage impressed across the resistive divider network immediately transmits a signal through the gate lead 49 to turn on the SCR 48 and immediately energize the solenoid 37, causing the valve member 27 to pivot to its first operational mode, immediately closing the second outlet 22 to the hot air duct 17 and opening the first outlet 21 to discharge all of the hot moist exhaust air and hot dry air to the outside atmosphere through the conduit 23 and vent fitting 24. The valve member 27 remains in the first operational mode for the entire drying cycle, since it is not responsive to humidity while the seasonal switch 55 is in its "SUMMER" position. Since the relay coil 50 is isolated, the drying cycle is completely controlled by the existing conventional controls in the automatic clothes dryer 12 during the "SUMMER" operation.

As illustrated in FIG. 1, the electronic control unit 40 may be mounted on the wall 14, as illustrated by the phantom position of the unit 40'.

It is also within the scope of this invention to incorporate the diverter valve 10, including all of its controls, if desired, within the housing of a conventional clothes dryer 12 as original equipment.

The humidity sensor 42 may also be mounted exteriorly of the valve housing 19 in order to sense the humidity in the ambient atmosphere and thereby control the discharge of humid air from the dryer 12 into the living space, dependent upon the existing humidity in the living space.

It would also be possible to utilize other types of electrical motor devices, than the solenoid 37, for reciprocally rotating the rotary valve shaft 31.

It is therefore apparent that an improved diverter valve device has been provided for more accurately controlling the flow of hot moist air selectively in different directions from a single source, such as an automatic clothes dryer, depending upon the humidity level or value of the hot air or fluid. Such control is therefore automatically dependent upon the humidity value of the fluid, rather than being manually controlled, to minimize heat waste or excessive humidity levels in the living space.

What is claimed is:

1. A fluid flow control device for an automatic clothes dryer having an exhaust air outlet within an enclosure, a space within said enclosure, and a space outside said enclosure, comprising:

(a) a fluid conduit having an inlet and first and second outlets, (b) said inlet being in fluid communication with the exhaust air outlet of the automatic clothes dryer, (c) said first outlet being in fluid communication with the space outside the enclosure, (d) said second outlet being in fluid communication with the space within the enclosure, (e) valve means in said fluid conduit having a first operational mode opening fluid passage between said inlet and said first outlet and closing fluid passage between said inlet and said second outlet, and a second operational mode opening fluid passage between said inlet and said second outlet and closing passage between said inlet and said first outlet, and (f) humidity sensitive control means operatively connected to said valve means for positioning said valve means in said first operational mode or said second operational mode in response to predetermined values of humidity sensed by said control means.

2. The invention according to claim 1 in which said second outlet is in fluid communication with a duct of hot air circulating system within the enclosure.

3. The invention according to claim 1 in which said valve means comprises a valve member, means mounting said valve member in said fluid conduit for movement between said first and second operational modes, said humidity sensitive control means comprising a humidity sensor, an operator device operatively connected to said valve member, and electrical control means responsive to said humidity sensor for actuating said operator device for moving said valve member.

4. The invention according to claim 3 in which said valve member mounting means comprises rotary shaft means pivotally mounting said valve member in said fluid conduit for pivotal movement between said first and second operational modes, said operator device being operatively connected to said shaft means for reciprocally moving said valve member.

5. The invention according to claim 4 in which said fluid conduit is a Y-shaped tubular conduit comprising an inlet portion including said inlet and diverging first and second branch outlet portions including respectively said first and second outlets, said valve member being adapted to close said second outlet portion in said first operational mode and to close said first outlet portion in said second operational mode.

6. The invention according to claim 5 in which said operator device comprises an electrical motor device mounted on said tubular conduit and operatively connected to said rotary shaft means.

7. The invention according to claim 6 in which said electrical motor device comprises an electrical solenoid having an armature shaft, and rack and pinion means operatively connecting said armature shaft to said rotary shaft means.

* * * * *